US010442660B2

(12) United States Patent
Herkel et al.

(10) Patent No.: US 10,442,660 B2
(45) Date of Patent: Oct. 15, 2019

(54) ELEVATOR BRAKE CONTROL SYSTEM

(71) Applicant: Otis Elevator Company, Farmington, CT (US)

(72) Inventors: Peter Herkel, Berlin (DE); Frank Kirchhoff, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/509,643

(22) PCT Filed: Sep. 12, 2014

(86) PCT No.: PCT/EP2014/069526
§ 371 (c)(1),
(2) Date: Mar. 8, 2017

(87) PCT Pub. No.: WO2016/037665
PCT Pub. Date: Mar. 17, 2016

(65) Prior Publication Data
US 2017/0283212 A1 Oct. 5, 2017

(51) Int. Cl.
*B66B 1/32* (2006.01)
*B66B 5/02* (2006.01)
*B66B 11/00* (2006.01)

(52) U.S. Cl.
CPC ..... *B66B 1/32* (2013.01); *B66B 5/02* (2013.01); *B66B 5/027* (2013.01); *B66B 11/0045* (2013.01)

(58) Field of Classification Search
CPC .. B66B 1/32; B66B 5/02; B66B 5/027; B66B 11/0045
(Continued)

(56) References Cited

U.S. PATENT DOCUMENTS 4,484,127 A 11/1984 Salihi et al.
5,489,828 A 2/1996 Palleggi
(Continued)

FOREIGN PATENT DOCUMENTS

CN 1478050 A 2/2004
CN 1871172 A 11/2006
(Continued)

OTHER PUBLICATIONS

International Search Report and Written Opinion for applicaiton PCT/EP2014/069526, dated May 11, 2015, 8 pages.
(Continued)

*Primary Examiner* — David S Warren
(74) *Attorney, Agent, or Firm* — Cantor Colburn LLP

(57) ABSTRACT

An elevator brake control system (10) is described, in particular for controlling an elevator brake in a machine room-less elevator, the elevator including a drive machine drivingly coupled to an elevator car for moving the elevator car between a plurality of landings in a hoistway, and an elevator brake having at least an engaged condition for holding the elevator car at a fixed position in the hoistway, and a released condition for allowing the elevator car to move along the hoistway; the elevator brake control system (10) comprising a first safety device (T1) and a second safety device (T2), each of the first safety device (T1) and the second safety device (T2) responsive to detection of a failure in any sub-system of the elevator, such as to bring the elevator brake into its engaged condition in response to detection of such failure; wherein each of the first safety device (T1) and the second safety device (T2) comprises a power semiconductor switching device.

18 Claims, 2 Drawing Sheets

(58) Field of Classification Search
USPC ..... 187/393
See application file for complete search history.

(56) References Cited

U.S. PATENT DOCUMENTS 6,056,088 A 5/2000 Gerstenkorn
6,173,814 B1 1/2001 Herkel et al.
6,364,066 B1 4/2002 Bolch et al.
7,575,099 B2 8/2009 Oh et al.
7,650,968 B2 * 1/2010 Oesterle ..... B66B 5/021 187/290
7,677,362 B2 * 3/2010 Shimohata ..... B66B 5/06 187/277
7,730,998 B2 * 6/2010 Takahashi ..... B66B 1/32 187/287
7,770,698 B2 * 8/2010 Okamoto ..... B66B 5/02 187/288
8,162,108 B2 * 4/2012 Sirigu ..... B66B 5/0068 187/289
8,186,483 B2 5/2012 Sirigu et al.
8,584,812 B2 11/2013 Dorsch et al.
9,422,135 B2 * 8/2016 Rogers ..... B66B 5/0018
2007/0056808 A1 * 3/2007 Shimohata ..... B66B 5/06 187/373
2007/0187185 A1 * 8/2007 Abraham ..... B66B 5/0031 187/288
2009/0127029 A1 * 5/2009 Oesterle ..... B66B 5/021 187/290
2009/0223746 A1 * 9/2009 Takahashi ..... B66B 1/32 187/247
2010/0044159 A1 * 2/2010 Okamoto ..... B66B 1/32 187/288
2010/0155184 A1 * 6/2010 Sirigu ..... B66B 5/0068 187/302
2011/0088982 A1 4/2011 ****Chen
2011/0120810 A1 * 5/2011 Schroeder-Brumloop ..... B66B 5/027 187/290
2011/0278099 A1 11/2011 ****Kattainen et al.
2012/0175193 A1 * 7/2012 Sirigu ..... B66B 5/0068 187/314
2013/0060432 A1 3/2013 Take et al.
2014/0027210 A1 * 1/2014 Rogers ..... B66B 5/0018 187/393
2014/0069745 A1 3/2014 Dellarippa et al.
2017/0253460 A1 * 9/2017 Vakkamaki ..... B66B 1/32
2017/0279397 A1 * 9/2017 Marks ..... B66B 25/00
2017/0283212 A1 * 10/2017 Herkel ..... B66B 1/32
2017/0313547 A1 * 11/2017 Lefevre ..... B66B 1/30
2017/0313548 A1 * 11/2017 Nakari ..... B66B 1/32
2018/0375423 A1 * 12/2018 Ikeda ..... H02M 1/32

FOREIGN PATENT DOCUMENTS

CN 202063617 U 12/2011
CN 102341332 A 2/2012
CN 102596780 A 7/2012
CN 102795524 A 11/2012
CN 103459286 A 12/2013
CN 103842277 A 6/2014
DE 202013009493 U1 3/2014
EP 0557570 A1 9/1993
EP 2326006 A1 * 5/2011 ..... B66B 13/22
EP 2326006 A1 5/2011
JP 2012255468 A 12/2012
WO 2011001197 A1 1/2011
WO 2013178872 A1 12/2013
WO 2013178874 A1 12/2013
WO 2014031112 A1 2/2014

OTHER PUBLICATIONS

First Chinese Office Action for application CN 201480081921.3, dated May 22, 2018, 10 pages.
Chinese Second Office Action for application CN 201480081921.3, dated Jan. 7, 2019, 8 pages.

* cited by examiner

ELEVATOR BRAKE CONTROL SYSTEM

The present invention relates to an elevator brake control system, particularly to a system for controlling a brake in a machineroom-less elevator.

Elevator brakes are usually constructed as fail-safe brakes, i.e. without supply of electrical energy to release the brake, the brake is in its engaged condition in which the braking mechanism blocks movement of the elevator car. Elevator safety standards require a redundant brake system. For example, safety standard EN 81-1 requires two independent safety relays for interrupting supply of electric power to the elevator brake in case of malfunction, e.g. in case of an open safety contact in a safety chain of the elevator.

Each of the safety relays conventionally used in elevator brake control systems is an electro-mechanical switching device responsive to a failure detection system of the elevator, usually a least one safety chain including a number of safety switches. As long as all the safety switches in the safety chain are closed, the safety relay will be in closed condition and therefore allow supply of electric power to release the elevator brake. In case at least one of the safety switches in the safety chain opens, the safety relay will switch into an open condition, thereby interrupting supply of electric power to the elevator brake and causing the elevator brake to enter into the engaged state to brake the elevator car.

According to current safety standards, during normal elevator operation, the elevator brake is controlled by two separate control circuits: A first control circuit provides for the brake safety function of the elevator brake and comprises the two independent safety relays. The first control circuit makes sure that the elevator brake is in its engaged condition braking the elevator car, in case at least one safety switch in the safety chain is open. A second control circuit provides for the brake performance function of the elevator brake and comprises a separate transistor circuit to adjust a desired time/current profile for: (i) releasing the elevator brake when the car starts moving, (ii) holding the elevator brake in released condition during travel of the car; and (iii) engaging the elevator brake when the car is to stop. The performance function is not safety related, and therefore, it not required to realize the second circuit in a redundant manner. Usually, the performance function is provided by only one second control circuit which is independent of the first control circuit. Typically, the second control circuit is connected in series to the first control circuit.

In emergency cases, where the car has been braked by interrupting supply of electric power to the elevator brake, it might happen that the car has been stopped on its way in between adjacent landings in the hoistway. In that case, passengers trapped in the car need to be rescued by manually moving the car to the next safe landing. For manual rescue of trapped passengers the elevator brake needs to be released to allow the car to move to a near landing. The brake release operation is usually performed with the help of a key switch, often called brake release switch BRB2. In conventional elevators with machine room, the brake release switch is located in the machine room, close to the drive machine of the elevator. In machine room-less elevators where the drive machine is located in the hoistway and thus hardly accessible, the brake release switch is located at an accessible position in the hoistway, or even on a control panel outside the hoistway. The brake release switch is manually operated by a service person, usually requiring a specific key to be operated for activation of the brake release switch. Once activated, the brake release switch enables an electric emergency system for temporarily releasing the engaged elevator brake. The brake release switch is of a normally open type, e.g. the brake release switch is equipped with a spring that forces the contact of the brake release switch into a position where the brake release function is disabled. Therefore, the brake release switch needs to be manually operated for releasing the elevator brake. When the brake release switch is released by the operator, the elevator brake will automatically return to the engaged condition. As this characteristic is essential for the safe operation, the brake release switch needs to be certified to the corresponding standard.

A problem, particularly in the case of machine room-less elevators, is that the brake release switch needs to reside at an accessible position in the hoistway or even outside the hoistway, e.g. at a control panel, for access by authorized persons. However, the elevator brake, and often also the emergency power supply for the elevator brake (e.g. batteries), reside in the hoistway, close to the elevator machine. Therefore, an electrical connection is required between the brake release switch and the elevator brake. Depending on vertical extension of the hoistway, such electrical connection, e.g. by way of wire or cable, may be very long. This is disadvantageous, particularly when considering that a relatively large electrical current is required to release the elevator brake against the mechanical biasing force engaging the elevator brake. Often, large cross section wiring is required increasing costs significantly.

It would be beneficial to provide a control system for an elevator brake being less complex but still allowing to provide a level of safety comparable to conventional elevator brake control systems as specified in relevant safety codes (e.g. EN 81-1). Particularly, it would be beneficial if such simplified elevator brake control system provides for redundant brake release function as well as for brake performance function.

An embodiment described herein relates to an elevator brake control system, the elevator including a drive machine drivingly coupled to an elevator car for moving the elevator car between a plurality of landings in a hoistway, and an elevator brake having at least an engaged condition for holding the elevator car at a fixed position in the hoistway, and a released condition for allowing the elevator car to move along the hoistway. The elevator brake control system comprises a first safety device and a second safety device, each of the first safety device and the second safety device responsive to detection of a failure in any subsystem of the elevator, such as to bring the elevator brake into its engaged condition in response to detection of such failure; wherein each of the first safety device and the second safety device comprises a power semiconductor switching device.

The elevator brake control system suggested herein is particularly configured for controlling an elevator brake in a machine room-less elevator.

A further embodiment described herein relates to a machine room-less elevator including a brake control system as referred to above.

Particular embodiments of the invention will be described in detail below with reference to the enclosed figures, wherein.

Figure 1:
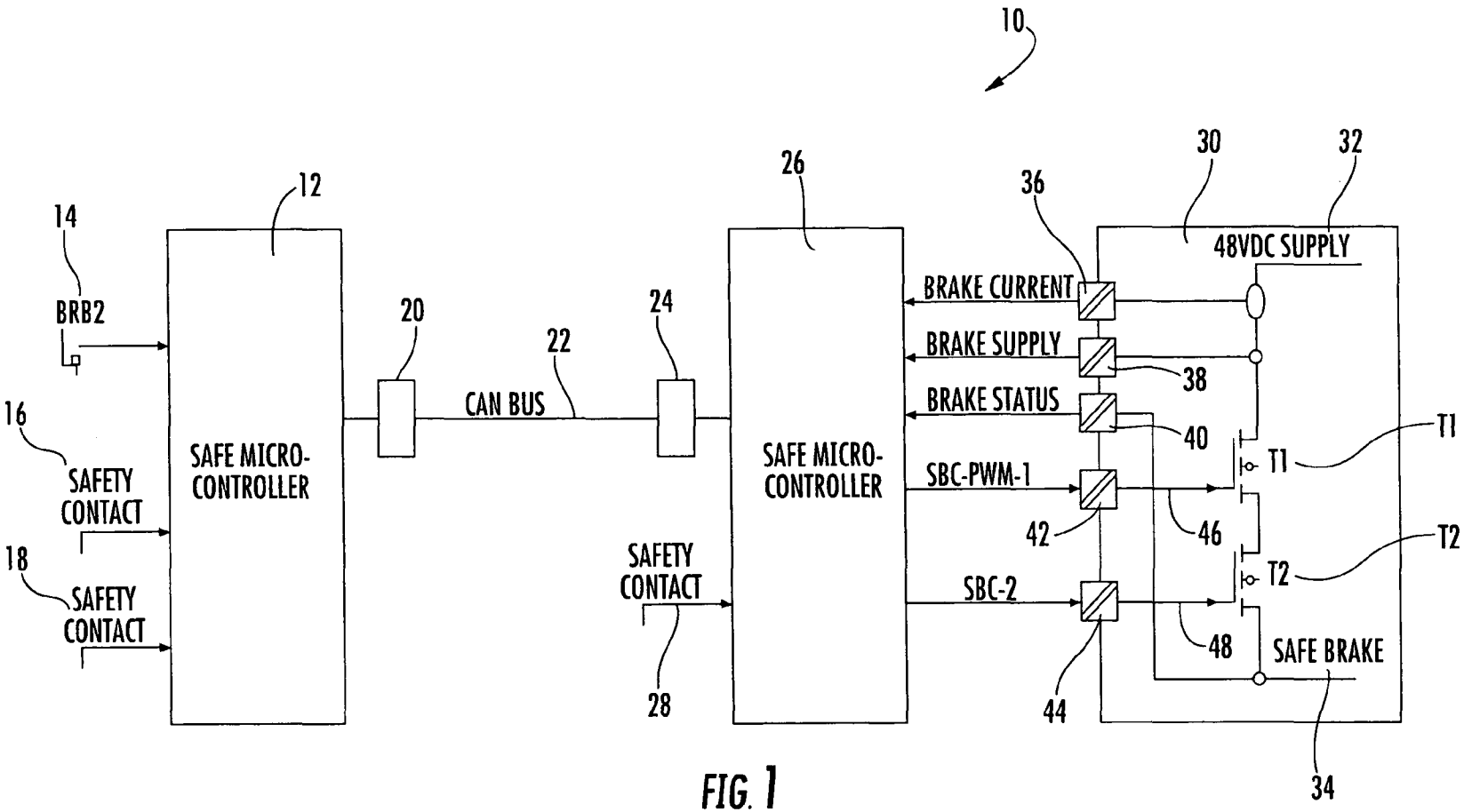
FIG. 1 shows a circuit diagram of a system for controlling an elevator brake according to an embodiment.

FIG. 1 shows a circuit diagram of a system 10 for controlling an elevator brake according to an embodiment. In FIG. 1 only those parts of the elevator brake control system 10 relevant for understanding the present invention are shown. Other parts of the control system are omitted for sake of brevity, it be understood that such parts will be present in reality.

FIG. 1 shows a brake operation circuit 30 for providing the electric operating force required to operate an elevator brake (the elevator brake itself is not shown). The elevator brake is of a "normally-closed" type, i.e. the elevator brake is subject to a biasing force (typically produced mechanically, e.g. by a biasing spring). Under the biasing force the elevator brake will be in an engaged condition blocking any movement of the elevator car, unless the biasing force of the elevator brake will be compensated by applying an operating force to the elevator brake sufficiently large to compensate the biasing force. Such operating force is produced by the brake operation circuit 30 based on control commands produced and processed by a brake control circuit 26. Thus, brake operation circuit 30 produces an operating force sufficiently large to, when fully applied to the elevator brake, release the elevator brake against the biasing force.

The brake operation circuit 30 comprises as its main components a brake release power supply 32, a brake operation terminal 34, as well as a first power semiconductor switching device T1 and a second power semiconductor switching device T2. The brake release power supply 32 provides for the electric energy required to produce a compensating force large enough to compensate for the biasing force of the elevator brake and to release the elevator brake. In the embodiment shown in FIG. 1, the brake release power supply is a DC power supply providing DC power with a rated voltage of 48 V, it be understood that in other embodiments the brake release power supply may have another rated voltage and may even be an AC power supply instead of a DC power supply. The brake release power supply 32 has two components: A first component is operative under normal operation of the elevator and is supplied by the normal main power grid of a building (typically 230V, 50/60 Hz AC or 110 V/60 Hz AC). In case of a DC brake release power supply 32, the first component typically will involve a switch-mode power supply, or other power supply fed by the main power grid and configured to transform the AC voltage from the power grid to a DC voltage with the rated voltage. The brake release power supply will be configured such as to deliver sufficient electrical power for providing the compensating force at the rated voltage of the brake release power supply. The brake release power supply 32 also includes a second component which will be active in cases where supply of power from the main power grid of the building is interrupted, or otherwise distorted. Elevator safety requirements usually specify that the elevator car has to be stopped in case of interruption or distortion of the main power supply in a building. In such cases, the elevator car will no longer be driven by the elevator drive machine, and the elevator brake will engage under the biasing force applied to it in the absence of any brake releasing forces applied by the brake operation circuit 32 to compensate the biasing force. However, it may be necessary to still move the elevator car in the hoistway under such emergency conditions, since the elevator car might be stopped on its travel path in the hoistway at a position in between two landings. Then, the elevator car will have to be moved to the next safe landing in order to evacuate any passengers potentially trapped in the elevator car. Therefore, it is required to have an additional source of electric energy which is independent of the main power grid available in a building. Typically such emergency power supply is provided by a battery, or some other form of electrical storage device, having a capacity expected to be sufficient for moving the fully load car to the next landing.

In the embodiment of FIG. 1, and generally in embodiments as described herein, the brake release power supply 32 may include, as an additional component, an emergency power supply, configured to be activated instead of the normal power supply in cases where the normal power supply is interrupted or distorted.

Electrical energy from the brake release power supply 32 is provided to the elevator brake via the brake operation terminal 34 of the brake operation circuit 30.

Elevator safety requirements further specify that in case of malfunction in an elevator system, any electrical power be disconnected from the drive machine of the elevator, and also from the elevator brake, by means of at least two redundant safety devices. Usually, such safety devices have the configuration of electro-mechanical switching devices (electro-mechanical relays) which are responsive to opening of any safety contacts in a safety chain and which mechanically separate both the drive machine and the brake of the elevator from its power supply by opening of a mechanical contact between the drive machine power supply and the drive machine as well as between the brake release power supply and the elevator brake.

In the embodiment shown in FIG. 1, a first power semiconductor switching device T1 as well as a second power semiconductor switching device T2 are connected in series to each other. The first and second power semiconductor switching devices T1 and T2 are also connected in series to the brake release power supply 32 and the brake operation terminal 34. No electro-mechanical switching devices are provided in the embodiment of FIG. 1 for separating the electrical connection between the brake release power supply 32 and the brake operation terminal 34 in case of detection of a failure anywhere in the safety chain or by any other safety contact in the elevator system (FIG. 1 shows exemplary safety contacts 16, 18, 28, but other safety contacts are conceivable as well). Rather, the first power semiconductor switching device T1 and the second power semiconductor switching device T2 are used as a replacement for the traditionally used electro-mechanical switching devices.

Each of the first power semiconductor switching device T1 and the second power semiconductor switching device T2 has the configuration of a power semiconductor transistor, e.g. a power metal oxide semiconductor transistor (MOSFET) or an insulated gate bipolar transistor (IGBT). Each of the first power semiconductor switching device T1 and the second power semiconductor switching device T2 has a source terminal, a drain terminal, and a gate electrode. The gate electrode 46, 48 is formed in a region interconnecting the source terminal and the drain terminal of each of the power semiconductor transistors T1, T2. Depending on the electrical potential of the gate electrode 46, 48, an electrically conductive channel may be formed connecting the source terminal and the drain terminal of the power semiconductor switching device T1, T2 with each other. Therefore, the first and second power semiconductor switching devices T1, T2 may be used as switching devices which do form an electrically conductive path connecting the source and drain terminals of the respective power semiconductor transistor T1, T2 if a suitable control voltage is applied to the respective gate electrode 46, 48.

The source drain channels of the first and second power semiconductor transistors T1 and T2 are connected in series, i.e. the drain terminal of the first power semiconductor transistor T1 is connected to the source terminal of the second power semiconductor transistor T2. The source terminal of the first power semiconductor transistor T1 is connected to the brake release power supply 32 while the drain terminal of the second power semiconductor transistor T2 is connected to the brake operation terminal 34.

Operation of the brake operation circuit 30 is controlled by a brake control circuit 26 assigned to the brake operation circuit 30. Brake control circuit 26 is a microprocessor circuit having a fail safe configuration including at least two microprocessor circuits in a redundant configuration where the first microprocessor circuit and the second microprocessor circuit have a same configuration and provide the same functionalities, with the first microprocessor circuit and the second microprocessor circuit exchanging information in order to monitor correct operation of the other microprocessor circuit. A fail safe microprocessor circuit of the type used in brake control circuit 26 is described in U.S. Pat. No. 6,173,814 to which reference is made.

Brake control circuit 26 provides a first control signal SBC-PWM-1 to an interface 42 of brake operation circuit 30 assigned to the gate electrode 46 of the first power semiconductor transistor T1. Moreover, brake control circuit 26 provides a second control signal SBC-2 to a further interface 44 of brake operation circuit 30 assigned to the gate electrode 48 of the second power semiconductor transistor T2.

The first control signal SBC-PWM-1 includes a base component and a modulation component applied to the base component. The base component of the first control signal SBC-PWM-1 basically is a two level signal comprising a first level corresponding to a gate potential 46 of the first power semiconductor transistor T1 where the source drain channel of the first power semiconductor transistor T1 is non-conductive, and thus the elevator brake would be fully engaged under its biasing force. The base component of the first control signal SBC-PWM-1 also includes a second level corresponding to a gate potential 46 of the first power semiconductor transistor T1 where the source drain channel of the first power semiconductor transistor T1 is fully conductive, and thus the elevator brake would be fully released against its biasing force. Moreover, the first control signal SBC-PWM-1 includes a pulse width modulation component (PWM) in order to modulate the base component according to a desired time profile of engaged/released condition of the elevator brake. The pulse width modulation component therefore provides the elevator brake performance function of the elevator brake.

The second control signal SBC-2 only includes a base component of the same configuration as the base component according to the first control signal SBC-PWM-1, but does not include any modulation applied to the base component. Rather, the second control signal SBC-2 includes a first level corresponding to a gate potential 48 of the second power semiconductor transistor T2 where the source drain channel of the second power semiconductor transistor T2 is non-conductive, and thus the elevator brake would be fully engaged under its biasing force. Moreover, second control signal SBC-2 includes a second level corresponding to a gate potential 48 of the second power semiconductor transistor T2 where the source drain channel of the second power semiconductor transistor T2 is fully conductive, and thus the elevator brake would be fully released against its biasing force.

The brake operation circuit 30 includes various interfaces 36, 38, 40 for providing information on the status of the brake operation circuit 30, in particular on the status of the first power semiconductor transistor T1 and on the status of the second power semiconductor transistor T2. A brake current interface 36 provides information on an electric current flowing in the circuit section of the brake operating circuit 30 on the brake release power supply 32 side of the first power semiconductor transistor T1 (in the following: "Brake current"). A brake supply interface 38 provides information on a voltage of a point of brake operating circuit 30 on the brake release power supply 42 side of the first power semiconductor transistor T1 with respect to the voltage of a point of the brake operating circuit 30 on the brake operation terminal 34 side of the second power semiconductor transistor T2 (in the following: "Brake supply"). A brake status interface 40 provides information on an electric current flowing in the circuit section of the brake operating circuit 30 on the brake operation terminal 34 side of the second power semiconductor transistor (in the following: "Brake status").

The signals "Brake current", "Brake supply", and "Brake status" are read from I/O interfaces 36, 38, and 40, respectively, and fed into the brake control circuit 26. Based on these signals, the brake control circuit 26 periodically carries out an integrity test sequence with respect to correct operation of the brake operation circuit 30, in particular with respect to correct switching characteristics of the power semiconductor transistors T1 and T2, as outlined in more detail with respect to FIG. 2 below.

The brake control circuit 26 is connected to other subsystems of the elevator by a communication network 22 via a network access point 24. Such further subsystems of the elevator may include the elevator control, various controllers for the drive machine of the elevator, an emergency and inspection control of the elevator, car controllers, floor controllers, etc. In FIG. 1 only one additional controller 12 is shown for sake of brevity connected to the elevator communication network via its own network access point 20, it be understood that in reality communication network 22 will connect a plurality of controllers including those mentioned before.

In FIG. 1 the additional controller 12 connected to the brake control circuit 26 is assigned to an emergency and inspection panel which is located outside the hoistway or in the hoistway such as to be accessible for maintenance persons for purposes of inspection and maintenance. The emergency and maintenance panel also includes an emergency rescue control section including a brake release switch BRB2 and an emergency rescue control circuit, as indicated by reference numeral 14. By operating the brake release switch it is possible to release the elevator brake manually in case of an emergency when the brakes of the elevator are engaged to stop the car, and the drive machine has been electrically disconnected from its power supply. In such case, the brake release power supply 32 will be disconnected from the main power grid of the building. However, as described before, the brake release power supply 32 also includes an emergency power supply (e.g. a battery) which will be activated in case of an emergency when the emergency rescue control section 14 is activated (e.g. by activating the brake release switch BRB2 on the emergency and inspection panel), in order to supply the electric energy necessary for temporarily releasing the elevator brake. Command signals for activating the emergency release mode, deactivating power supply from the main power supply and activating power supply from the emergency power supply are exchanged between the the controllers 12 and 26 via the communications network 20, 22, 24. Also, command signals for temporarily releasing the elevator brake in the course of an emergency rescue operation, to move the elevator car to the next landing, are input via the emergency and inspection panel (e.g. by operating the brake release switch) and then communicated to the brake control circuit 26 via the communications network. The emergency and inspection panel, as well as the emergency and inspection control circuit 12 assigned to it, may be located at any suitable location in the hoistway or near the hoistway, even very remotely from the brake control circuit 26 if necessary, since only brake operation commands are to be transmitted via the communications network, but not other signals requiring large power. It may even be possible to locate the brake release switch BRB2 and the brake release controller 14 assigned to it on a separate control panel completely remote from the elevator, e.g. in a central maintenance and emergency facility operated by the supplier. Then, an emergency rescue operation for evacuating passengers from the elevator car may be effected and controlled remotely, even without the need to sent a service technician to the elevator.

The communication network 20, 22, 24 may have the configuration of a field bus, e.g. a CAN bus (=Controller Area Network). Control of operation of an elevator via such communication network is described in U.S. Pat. No. 6,173,814. For sake of brevity reference is made to that document. Moreover, WO 2011/001197 A1 describes control of a rescue operation in an elevator system via a rescue operations panel being disposed remotely from a rescue operation device and connected to the rescue operation device by a communication network. Reference is also made to the disclosure in that document.

As indicated in FIG. 1, the elevator brake control unit 26 is responsive to signals delivered by various safety contacts 16, 18, 28. In case one of these safety contacts 16, 18, 28 opens, the brake control circuit 26 will cause an interruption of the brake release power supply 32 so that brake release power is no longer supplied to the brake operations terminal 34. Interruption of brake release power supply is effected by switching the power semiconductor devices T1 and T2 into their non-conductive condition, as set out above. Safety contacts 16, 18, 28 may be connected to the brake control circuit 26 directly (as indicated by reference numeral 28 in FIG. 1), but may be connected to other nodes in the communications network 20 22, 24 as well, as indicated by the reference numerals 16, 18 in FIG. 1 which are connected to the additional controller 12 assigned to the emergency and inspection panel. In such case, any information on open safety contacts 16, 18 will be transmitted to the elevator brake control circuit 26 via the communications network 20, 22, 24.

Figure 2:
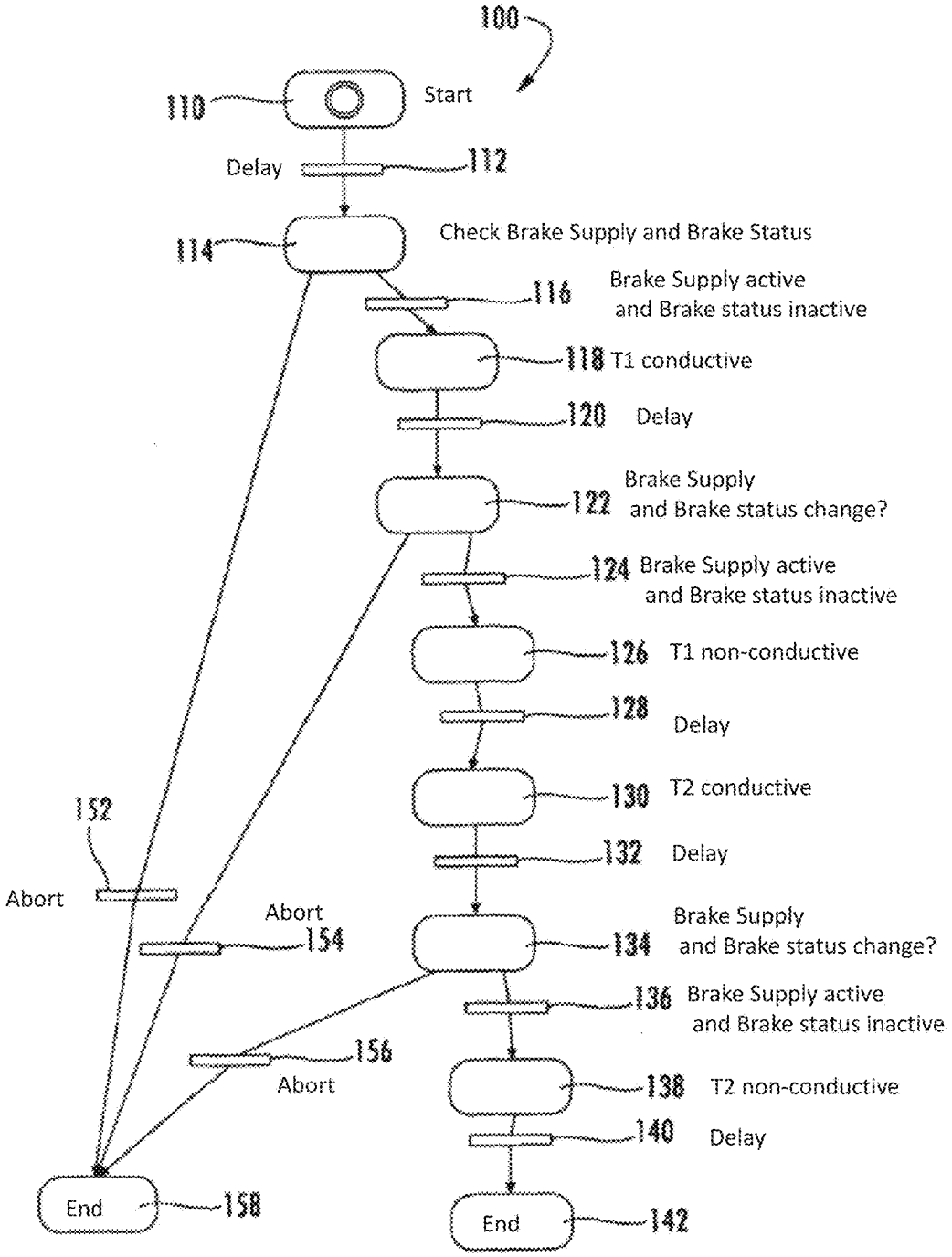
FIG. 2 shows a diagram illustrating an integrity testing sequence as carried out by the system for controlling an elevator brake according to the embodiment to ensure correct operation of the first and second power semiconductor switching devices in the elevator brake control system.

FIG. 2 shows a diagram illustrating an integrity test sequence 100 to ensure correct operation of the first and second power semiconductor switching devices T1, T2, as carried out by the system 10 for controlling an elevator brake according to the embodiment. Integrity test sequence 100 is carried out for verifying integrity of the brake operation circuit 30. Integrity test sequence 100 particularly may be performed intermittently at time intervals short enough to regularly detect any fault in the first power semiconductor switching device T1 and/or in the second power semiconductor switching device T2. Principally, the integrity test sequence 100 may be carried out in regular time intervals, e.g. every 10 minutes, every hour, every day, or every week, depending on operational characteristics of the elevator. Further, the integrity test sequence 100 may be performed before each start of the elevator car, provided the elevator car has been out of use for a predetermined time (e.g. one hour or one day). The elevator car might be considered out of use for the purposes of this disclosure if it did not serve any transportation requests by users. To be on the very safe side, integrity test sequence 100 may be carried before each movement of the elevator car to service a passenger request.

Integrity test sequence 100 is based on checking the level of electric potential and/or electric current at various points in the brake operation circuit 30 after opening the source drain channels (i.e. changing condition of the source drain channels to conductive) and/or closing the drain source channels (i.e. changing the condition of the source drain channels to non-conductive) of the first power semiconductor switching device T1 and the second power semiconductor switching device T2 in a predetermined pattern. Integrity test sequence 100 first detects the electric potential between a first contact on the supply side of the first semiconductor switching device T1 and a second contact on the brake output side of the second power semiconductor switching device T2. Such voltage is output as a signal "Brake supply" by the brake operation circuit 30 via interface 38 to the brake control circuit 26. Integrity test sequence 100 also determines an electric current in the circuit section of the brake operation circuit 30 on the supply side of the first semiconductor switching device T1. Such current is output as a signal "Brake current" by the brake operation circuit 30 via interface 36 to the brake control circuit 26. Moreover, integrity test sequence 100 determines an electric current in the circuit section of the brake control circuit 30 on the brake output side of the second power semiconductor switching device T2. Such current is output as a signal "Brake status" by the brake operation circuit 30 via interface 40 to the brake control circuit 26.

Integrity test sequence 100 starts at step 110 in FIG. 2. After waiting a predetermined time in step 112, integrity test sequence 100 first determines the signals "Brake supply", and "Brake status" while both power semiconductor switching devices T1, T2 are in non-conductive condition, i.e. the source drain channels of both power semiconductor switching devices T1, T2 are in a non-conductive condition, see step 114. In that condition, the voltage "Brake supply" should be equal to the rated voltage of the brake release power supply 32 (in the example of FIG. 1, rated voltage of the brake release power supply is 48 V DC). The electric current "Brake status" should be zero. If these conditions are fulfilled, the procedure considers in step 116 that "Brake supply" is active and that "Brake status" is inactive, and proceeds to step 118.

Otherwise, the integrity test sequence proceeds to step 152 and aborts the integrity test sequence 100 with the finding that integrity of the brake operation circuit 30 is not given, step 158.

In step 118, the integrity test sequence 100 changes the condition of the source drain channel of the first power semiconductor switching device T1 from non-conductive to conductive by applying a respective control voltage to gate terminal 46 of the first power semiconductor switching device T1. Change of gate voltage 46 of the first power semiconductor switching device T1 is effected by brake control circuit 26 by changing the value of the signal "SBC-PCM-1" which is written to interface 42 of brake operation circuit 30. In step 118 the integrity test sequence does not change the voltage at gate terminal 48 of the second power semiconductor switching device T2, and therefore the source drain channel of the second power semiconductor switching device T2 remains to be in non-conductive condition.

The integrity test sequence 100 then proceeds to step 120 and waits for a predetermined time, until it determines in step 122 again the values of the signals "Brake supply", and "Brake status" as present in interfaces 38 and 40 of brake operation circuit 30. The values of these signals should not change significantly in case both the first and second power semiconductor device switching device T1, T2 operate correctly. If the determination in step 122 reveals that the values of "Brake supply" and "Brake status" did not change within predefined thresholds, the integrity test sequence 100 determines in step 124 that "Brake supply" still is active and "Brake status" still is inactive, and proceeds to step 126.

Otherwise, the integrity test sequence proceeds to step 154 and aborts the integrity test with the finding that integrity of the brake operation circuit 30 is not given, step 158.

In step 126, the integrity test sequence 100 changes the condition of the source drain channel of the first power semiconductor switching device T1 from conductive to non-conductive by applying a respective control voltage to gate terminal 46 of the first power semiconductor switching device T1. Change of gate voltage 46 of the first power semiconductor switching device T1 is effected by brake control circuit 26 by changing the value of the signal "SBC-PCM-1" which is written to interface 42 of brake operation circuit 30. Then, the integrity test sequence waits a predetermined time in step 128. Further, in step 130 the integrity test sequence 100 changes the voltage at gate terminal 48 of the second power semiconductor switching device T2 such as to change the source drain channel of the second power semiconductor switching device T2 from non-conductive to conductive. Change of gate voltage 48 of the second power semiconductor switching device T2 is effected by brake control circuit 26 by changing the value of the signal "SBC-2" which is written to interface 44 of brake operation circuit 30.

The integrity test sequence 100 then proceeds to step 132 and waits for a predetermined time, until it determines in step 134 again the values of the signals "Brake supply", and "Brake status" as present in interfaces 38 and 40 of brake operation circuit 30. The values of these signals should not change significantly in case both the first and second power semiconductor device switching devices T1, T2 operate correctly. If the determination in step 134 reveals that the values of "Brake supply" and "Brake status" did not change within predefined thresholds, the integrity test sequence 100 determines in step 136 that "Brake supply" still is active and "Brake status" still is inactive, and proceeds to step 138. In step 138, the integrity test procedure changes condition of the source drain channel of the second power semiconductor switching device T1 back to non-conductive, such that both power semiconductor switching devices T1, T2 are returned to non-conductive condition. The integrity test sequence waits for a predetermined time in step 140 and then terminates successfully in step 142.

Otherwise, the integrity test sequence proceeds to step 156 and aborts the integrity test with the finding that integrity of the brake operation circuit 30 is not given, step 158.

Embodiments as described above provide for a brake control system that uses electronic communication for providing the brake release function with a level of safety comparable to prior art solutions, but at the same time providing the brake performance function independent of the brake release function.

Embodiments disclosed herein relate to a system and method for controlling an elevator brake, in particular for controlling an elevator brake in a machine room-less elevator. The elevator includes a drive machine drivingly coupled to an elevator car for moving the car between a plurality of landings located at different levels in a hoistway, and an elevator brake having at least an engaged condition for holding the elevator car at a fixed position in the hoistway, and a released condition for allowing the car to move along the hoistway. In case of a machine room-less elevator, there is no separate machine room for the drive machine and at least the essential components of the drive machine, like the drive sheave, tension member and drive motor, are located in the hoistway. The elevator brake control system includes a first safety device and a second safety device, each of the first safety device and the second safety device responsive to detection of a failure in any subsystem of the elevator, such as to bring the elevator brake into its engaged condition in response to detection of such failure. Each of the first safety device and second safety device comprises a power semiconductor switching device. In particular embodiments each of the conventionally used electromechanical safety relays may be replaced by a respective power semiconductor switching device.

Particularly, the elevator brake may be configured to engage the drive machine in a such way as to prevent transfer of driving forces from the drive machine to the elevator car. Therefore, in case of a machine room-less elevator, at least the essential components of the elevator brake may be located in the hoistway, adjacent to, or at least in close relationship to, the drive machine.

Particularly, the power semiconductor switching device may include a source terminal, a drain terminal, and at least one gate terminal. Then, the source terminal and the drain terminal may be electrically connected via a source drain channel, or may be electrically isolated from each other, depending on an electrical potential of the gate terminal. As used herein, a condition in which the source drain channel connecting source terminal and drain terminal is interrupted, thereby isolating the source terminal electrically from the drain terminal, will be referred to as an isolating or open condition of the power semiconductor switching device. A condition in which the source drain channel is electrically conductive will be referred to as a conductive or closed condition of the power semiconductor switching device.

Particularly, the first safety device and/or the second safety device may include a power semiconductor switching device in the configuration of at least one power semiconductor transistor including a source terminal, a drain terminal, and a gate terminal. E.g. the power semiconductor transistor may have the configuration of at least one of a power metal oxide semiconductor transistor (MOSFET) and an insulated gate bipolar transistor (IGBT).

Particularly, the first safety device and the second safety device may be connected in series with each other, such as to connect the source drain channel of the first power semiconductor switching device in series to the source drain channel of the second power semiconductor switching device, or vice versa.

The elevator brake control system may include a brake release power supply and a brake operation terminal. The brake release power supply may be connected on the side of the source terminals of the power semiconductor switching devices. The brake operation terminal may be connected on the side of the drain terminals of the power semiconductor switching devices. Then, electrical power for releasing the elevator brake, but also electrical power required for other functions related to elevator brake operation, may be supplied from the brake release power supply to the brake operation terminal via the source-drain channels of the power semiconductor transistors. In case the source drain channels of the first and second power semiconductor switching devices are connected in series, for releasing the elevator brake both the first safety device and the second safety device need to be switched into the conducting condition in which the source drain channel of the respective power semiconductor transistor is electrically conductive.

The system for controlling an elevator brake further may comprise a brake operation circuit including the first power semiconductor switching device and the second power semiconductor switching device, the brake operation circuit configured to electrically connect the brake release power supply to the elevator brake such as to release the elevator brake, depending on the switching condition of the first power semiconductor switching device and/or the second power semiconductor switching device. The brake release power supply may be a normal operation brake release power supply, e.g. a DC power supply, to release the elevator brake in normal operation, i.e. when the car is required to travel. The normal operation brake release power supply may be in connection with a public power grid, e.g. in the form of a switching power supply or a DC intermediate circuit. In addition, the brake release power supply may include an emergency brake release power supply configured to provide the electrical power for releasing the elevator brake in an emergency situation to allow the elevator car to reach the next safe landing in the hoistway. The emergency brake release power supply may e.g. include a DC battery. Thus, the same brake operation circuit may be used for releasing the elevator brake in normal operation as well as for releasing the elevator brake in rescue operation in case of an emergency.

The system for controlling an elevator brake further may comprise a brake control circuit having a first brake control terminal configured for connection to a control terminal of the first safety device, particularly to the gate terminal of the first power semiconductor switching device, and having a second brake control terminal configured for connection to a control terminal of the second safety device, particularly the gate terminal of the second power semiconductor switching device. The brake control circuit may be configured to supply a control voltage to the first brake control terminal independent of the supply of a control voltage to the second brake control terminal. In case the first power semiconductor switching device and/or the second power semiconductor switching device includes a power semiconductor transistor, respectively, the first brake control terminal and/or the second brake control terminal may be configured for connection to the gate terminal of the first and/or second power semiconductor transistor, respectively. According to the signal provided to the first and/or second brake control terminals of the brake control circuit, the first and/or second power semiconductor switching devices will be in a conductive condition, or will be in an isolating condition. Only with both the first and second power semiconductor switching devices in the conductive condition will the elevator brake be supplied with sufficient electrical power to release the elevator brake and/or hold the elevator brake in its released condition.

The brake control circuit may comprise at least one microprocessor and hence may have the configuration of a brake control microprocessor circuit. The brake control microprocessor circuit may have a fail-safe configuration, e.g. a configuration including at least two redundant microprocessors monitoring each other, as described in U.S. Pat. No. 6,173,814.

Thereby, the embodiments described so far use safety electronics, particularly power electronics, to physically separate the function of creating a brake release command from the function of carrying out the brake release operation. While the brake release command is produced by the brake control circuit and is supplied to the first and/or second brake control terminals (particularly, the gate terminals of the first and second power semiconductor switching devices), brake release operation is effected by a separate brake operation circuit including the first and second power semiconductor switching devices. Particularly, the source-drain channel of the first power semiconductor switching device and the source drain channel of the second power semiconductor switching device form part of the brake operation circuit electrically connecting a brake release power supply to the elevator brake in case the source drain channels of both the first power semiconductor switching device and the second power semiconductor switching device are opened. As the first and second safety devices include a power semiconductor switching device, respectively, the elevator brake is controlled, in normal operation and in rescue operation, by two power semiconductor switching devices, in particular by two power semiconductor transistors, instead of two electro-mechanic safety relays as in the prior art. The power semiconductor switching devices themselves are controlled and monitored by the safe brake control circuit.

It is desirable to keep electrical connections (e.g. wirings or cables) as short as possible. This particularly applies to the electrical connections in the brake operation circuit, as these electrical connections have to transport sufficiently large electrical power to be able to release the elevator brake against its biasing force. Therefore, the brake operation circuit including the brake release power supply assigned to it, but optionally also the brake control circuit, may be located in close proximity to the drive machine of the elevator, i.e. at a location in the hoistway relatively difficult to access for an operator, in case of a machine room-less elevator.

The control command for the elevator brake may be produced by the brake control circuit based on inputs from other sensors or subsystems in the elevator, e.g. specific safety contacts which may be isolated or may be included in one of various safety chains of the elevator. The control command for the elevator brake may also be based on manual inputs from an operator, e.g. in case of an emergency rescue operation. The brake control circuit may include respective interfaces or I/O devices for input of status information from safety contacts or for manual inputs.

Particularly, the brake control circuit may be integrated in a larger elevator control communications network including a plurality of network nodes interconnected via an electrical communications network. For example, the brake control circuit may be connected with further control circuits of the elevator control system by way of a field bus network, like a CAN bus (Control Area Network). The brake control circuit then forms one of the nodes of such electrical connections network, together with other nodes like elevator drive control located near the elevator machine, car operation controller located in the car, floor controllers located on each serviced floor, or an elevator rescue and maintenance operation panel for operation of the elevator by service personnel for purposes of maintenance and rescue of passengers, etc. All nodes are connected with each other by the electrical communications network (e.g. the field bus or CAN bus). Within such electrical communications network, the inputs required for the brake control circuit, as well as any information about the status of the elevator brake provided by the brake control circuit, may be exchanged between all nodes via the elevator control communications network. This allows the brake control circuit to evaluate the status of the different safety contacts assigned to different nodes in the elevator control communications network, such that it is not necessary to connect each safety contact relevant for operation of the elevator brake to the brake control circuit directly. Some field bus systems (e.g. the CAN bus) even allow to supply electrical power to various low power devices over the field bus, such that no separate power supply is required for such devices. This, however, does not apply to the electrical power required for driving the car and for the electrical power required to release the elevator brake. A separate power supply is required for these devices because the high power and voltage requirements for these devices cannot be provided by known field busses.

When integrating the brake control circuit in an elevator control communications network, brake release operations even may be controlled remotely, e.g. from another safe control circuit that is connected to the brake release switch BRB2 and positioned at some accessible location in the hoistway or even outside the hoistway. Commands input from the brake release switch will be transferred to the brake control circuit via the elevator control communications network. It is even possible to effect control of the elevator brake completely remotely via public telecommunication networks, e.g. telecommunication lines or the internet, in case the elevator control communications network includes interfaces to such public telecommunication networks.

In order to meet required levels of safety for the elevator brake control system described herein, integrity of the proposed control circuits may be checked. The brake operation circuit may be adapted to provide signals indicative of the status of the first and second power semiconductor switching devices. In particular embodiments, the brake operation circuit may provide interfaces for exchanging a number of monitoring signals to the brake control circuit, or to other control circuits, e.g. those referred to as "Brake current", "Brake supply" and "Brake status" in the following. These signals may be input to the brake control circuit, or any other control circuit, such that any fault in the two power semiconductor switching devices and/or at other components of the brake operation circuit may be detectable by analysing these signals. Particularly, these signals may be provided to the brake control circuit, and the brake control circuit might be adapted to evaluate these signals for monitoring integrity of the brake operation circuit, in particular integrity of the switching characteristics of the first and second power semiconductor switching devices. In other embodiments these signals may as well be provided to other nodes connected to the elevator control communications network and evaluated at these nodes.

A specific test sequence may be provided for identifying integrity of the brake operation circuit. Such test sequence particularly may be performed intermittently at time intervals short enough to regularly detect any fault in the first and/or second safety device and to ensure proper operation of the elevator brake. The integrity test sequence may be carried out in regular time intervals, e.g. every 10 minutes, every hour, every day, or every week, depending on operational characteristics of the elevator. For example, the integrity test sequence may be performed before each start of the elevator car, provided the elevator car has been out of use for a predetermined time (e.g. one hour or one day). The car might be considered out of use for the purposes of this disclosure if it did not serve any transportation requests by users. To be on the very safe side, an integrity test sequence of the type as described before may be carried out before each movement of the car to service a passenger request. To allow as much flexibility as possible, particularly an integrity test sequence may be used that may be carried out in relatively short time.

For testing integrity of the first and second safety devices each including at least one of suitable power semiconductor switching device, a suitable integrity test sequence might be carried out including checking the level of electric potential and/or electric current at various points in the brake operation circuit after opening and/or closing the drain source channels of the first and second power semiconductor switching devices in a predetermined pattern. For example, such integrity test sequence might first detect the electric potential between a first contact on the supply side of the first semiconductor switching device and a second contact on the brake output side of the second power semiconductor switching device (in the following referred to as "Brake supply"), as well as determining an electric current in the circuit section on the supply side of the first semiconductor switching device (in the following referred to as "Brake current"), and an electric current in the circuit section on the brake output side of the second power semiconductor switching device (in the following referred to as "Brake status") while both power semiconductor devices are closed. Brake supply should be equal to the rated voltage of the brake release power supply, and the electric currents in both circuit sections Brake current and Brake status should be zero. Then, the integrity test sequence might open the source drain channel of the first power semiconductor switching device while keeping the source drain channel of the second power semiconductor switch in closed state, and determine the signals Brake supply, Brake current, and Brake status again. The values of these signals should not change significantly in case both the first and second power semiconductor device switching device operate correctly. Then, the test sequence might close the source drain channel of the first power semiconductor switching device and open the source drain channel of the second power semiconductor switching device, and determine the signals Brake supply, Brake current, and Brake status again. Again, the values of these signals should not change significantly in case both the first and second power semiconductor switching device operate correctly.

In another embodiment the integrity test sequence may be based on measuring voltage differences between various points in the brake operation circuit. In addition to measuring a voltage difference between contacts on the supply side of the first semiconductor switching device and on the brake output side of the second power semiconductor switching device (the potential difference between these contacts was referred to as "Brake supply" above), also voltage differences between these contacts and a further contact located in between the two power semiconductor transistors can be measured. Voltage differences between these three contacts could be measured in situations as described above, i.e. one measurement with both power semiconductor switching devices closed; one measurement with first power semiconductor switching device in conducting condition and second power semiconductor switching device in isolating condition; and one measurement with first power semiconductor switching device in isolating condition and second power semiconductor switching device in conduction condition. The voltage differences measured by such test sequence allow to decide whether the switching characteristics are proper for both the first and second power semiconductor switching device.

Time required for carrying out an integrity test sequence as described above may be in the range below 100 ms, thereby allowing a repetition of the integrity test sequence at small time intervals, even each time before the car starts travelling to service a transport request.

The control command for opening the source drain channel of the first power semiconductor switching device as well as the control command for opening the source drain channel of the second power semiconductor switching device may additionally include a suitable modulation, e.g. a PWM modulation. This allows to adjust the brake timing and brake current for (i) releasing the elevator brake when the car starts moving, (ii) holding the elevator brake in released condition during travel of the car; and (iii) engaging the elevator brake when the car is to stop, i.e. to provide the performance function of the elevator brake by modulating at least one of the control commands for opening the source drain channel of the first power semiconductor switching device and/or of the second power semiconductor switching device of the brake operation circuit. It will be sufficient, and for purposes of synchronisation even be preferable, to modulate the control signal for only one of the two power semiconductor switching devices while letting the control signal for the other one of the power semiconductor switches unchanged. Thereby, not only the brake release function of the elevator brake can be implemented by the proposed elevator brake control system, but also the brake performance function can be implemented by the same control circuits, namely the brake control circuit and the brake operation circuit. Therefore, the control system proposed herein is adapted to combine the elevator brake safety function with the performance function for the elevator brake without compromising independent activation of each one of two safety devices each comprising a power semiconductor switching device.

The invention claimed is:

1. Elevator brake control system, in particular for controlling an elevator brake in a machine room-less elevator, the elevator including a drive machine drivingly coupled to an elevator car for moving the elevator car between a plurality of landings in a hoist-way, and an elevator brake having at least an engaged condition for holding the elevator car at a fixed position in the hoistway, and a released condition for allowing the elevator car to move along the hoistway;

the elevator brake control system comprising a first safety device (T1) and a second safety device (T2), each of the first safety device (T1) and the second safety device (T2) responsive to detection of a failure in any subsystem of the elevator, such as to bring the elevator brake into its engaged condition in response to detection of such failure;

a brake control circuit having a first brake control terminal connected to the gate terminal of the first power semiconductor switching device (T1) and having a second brake control terminal connected to the gate terminal of the second power semiconductor switching device (T2);

wherein each of the first safety device (T1) and the second safety device (T2) comprises a power semiconductor switching device;

wherein the brake control circuit is configured to supply a first control voltage (SBC-PWM-1) to the first brake control terminal and to supply of a second control voltage (SBC-2) to the second brake control terminal independent of the first control voltage (SBC-PWM-1);

wherein the first control signal (SBC-PWM-1) includes a base component and a modulation component applied to said base component; and wherein the second control signal (SBC-PWM-2) includes only a base component.

2. Elevator brake control system according to claim 1, wherein the power semiconductor switching device (T1, T2) includes a source terminal, a drain terminal and at least one gate terminal.

3. Elevator brake control system according to claim 2, wherein the power semiconductor switching device (T1, T2) includes at least one power semiconductor transistor having a source terminal, a drain terminal and one gate terminal.

4. Elevator brake control system according to claim 1, wherein the first safety device (T1) and the second safety device (T2) are connected in series with each other.

5. Elevator brake control system according to claim 1, wherein the elevator brake control system comprises a brake release power supply connected on a source side of the first and/or second power semiconductor switching device (T1, T2), and a brake operation control terminal connected on a drain side of the first and/or second power semiconductor switching device (T1, T2).

6. Elevator brake control system according to claim 5, wherein the brake release power supply includes an emergency brake release power supply configured to provide the electrical power for releasing the elevator brake in an emergency situation to allow the elevator car to reach the next safe landing in the hoistway.

7. Elevator brake control system according to claim 1, further comprising a brake operation circuit including the first power semiconductor switching device (T1) and the second power semiconductor switching device (T2), the brake operation circuit configured to electrically connect the brake release power supply to the elevator brake such as to release the elevator brake by supplying a brake release current, depending on the switching condition of the first power semiconductor switching device (T1) and/or the second power semiconductor switching device (T2).

8. Elevator brake control system according to claim 1, wherein the brake control circuit comprises at least one microprocessor.

9. Elevator brake control system according to claim 8, wherein the brake control circuit has a fail-safe configuration including at least two redundant microprocessors monitoring each other.

10. Elevator brake control system according to claim 1, wherein the brake control circuit is configured to receive a command for release of the elevator brake based on manual inputs from an operator, e.g. in case of an emergency rescue operation.

11. Elevator brake control system according to claim 1, wherein the brake control circuit is integrated in an elevator control communications network including a plurality of network nodes interconnected via an electrical communications network, particularly via a field bus.

12. Elevator brake control system according to claim 1, wherein the brake operation circuit is configured to provide signals (Brake current, Brake supply, Brake status) indicative of the status of the first power semiconductor switching device (T1) and the second power semiconductor switching device (T2).

13. Elevator brake control system according to claim 1, further configured to carry out a specific test sequence for identifying integrity of the brake operation circuit.

14. Elevator brake control system according to claim 13, being configured to carry out the integrity test sequence based on checking the level of electric potential and/or electric current at various points in the brake operation circuit after opening and/or closing the drain source channels of the two power semiconductor switches (T1, T2) in a predetermined pattern.

15. Elevator brake control system according to claim 1, wherein the brake control circuit is configured to apply the additional modulation component, to the first control signal (SBC-PWM-1) for opening the source drain channel of the first power semiconductor switching device (T1) for adjusting the brake timing and brake current for (i) releasing the elevator brake when the car starts moving, (ii) holding the elevator brake in released condition during travel of the car; and (iii) engaging the elevator brake when the car is to stop.

16. Elevator including an elevator brake control system according to claim 1, wherein the elevator is a machine room-less elevator and the essential components of the elevator brake are located in the hoistway, adjacent to, or at least in close relationship to, the drive machine of the elevator.

17. Elevator according to claim 16, wherein the elevator brake is configured to engage the drive machine of the elevator in a such way as to prevent transfer of driving forces from the drive machine to the elevator car.

18. Elevator brake control system according to claim 3, wherein the power semi-conductor transistor comprises at least one of a power metal oxide semiconductor transistor and an insulated gate bipolar transistor.

* * * * *